US006866749B2

(12) United States Patent
Delmas et al.

(10) Patent No.: US 6,866,749 B2
(45) Date of Patent: Mar. 15, 2005

(54) METHOD FOR BLEACHING PAPER PULP WITH ORGANIC PERACIDS FOLLOWED BY PEROXIDE AND SODIUM HYDROXIDE

(75) Inventors: Michel Delmas, Auzeville Tolosane (FR); Gérard Avignon, Estillac (FR)

(73) Assignee: Compagnie Industrielle de la Matiere Vegetale, Paris (FR)

( * ) Notice: Subject to any disclaimer, the term of this patent is extended or adjusted under 35 U.S.C. 154(b) by 0 days.

(21) Appl. No.: 10/380,066

(22) PCT Filed: Sep. 14, 2001

(86) PCT No.: PCT/FR01/02867

§ 371 (c)(1),
(2), (4) Date: Aug. 13, 2003

(87) PCT Pub. No.: WO02/22945

PCT Pub. Date: Mar. 21, 2002

(65) Prior Publication Data

US 2004/0035537 A1 Feb. 26, 2004

(30) Foreign Application Priority Data

Sep. 18, 2000 (FR) ..... 00 11831

(51) Int. Cl.[7] ..... D21C 9/16

(52) U.S. Cl. ..... 162/56; 76/78

(58) Field of Search ..... 162/18, 90, 29, 162/76, 78, 60, 56

(56) References Cited

U.S. PATENT DOCUMENTS 4,400,237 A 8/1983 Kruger et al.
5,431,781 A * 7/1995 Walsh ..... 162/76
6,007,678 A * 12/1999 Linsten et al. ..... 162/65

FOREIGN PATENT DOCUMENTS

WO WO 98 20198 5/1998

* cited by examiner

*Primary Examiner*—Steve Alvo
(74) *Attorney, Agent, or Firm*—Young & Thompson

(57) ABSTRACT

The invention concerns a method for bleaching different types of paper pulp in two steps at atmospheric pressure and at a temperature not higher than 100 DEG C. The first step consists in contacting the unbleached paste with a mixture of paracetic acid and performic acid. The second step consists in treating the bleached pulp derived from the first step, with a solution of soda and hydrogen peroxide. The resulting pulps exhibit a high index of whiteness and a degree of polymerisation close to unbleached pulps. The method is environmentally safe and non-polluting.

14 Claims, 1 Drawing Sheet

Diagram of the method of bleaching paper pulps in an aqueous-organic medium with controlled hydration

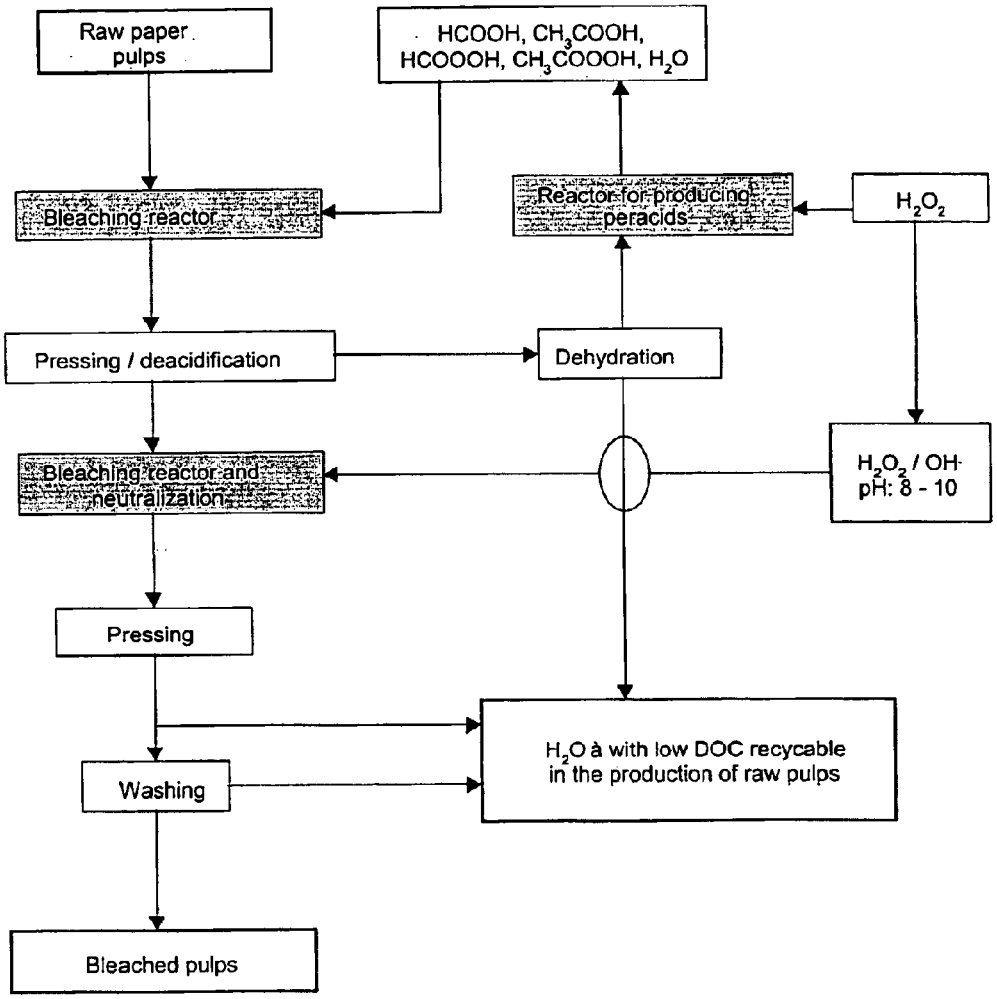
Figure 1: Diagram of the method of bleaching paper pulps in an aqueous-organic medium with controlled hydration

METHOD FOR BLEACHING PAPER PULP WITH ORGANIC PERACIDS FOLLOWED BY PEROXIDE AND SODIUM HYDROXIDE

CROSS REFERENCE TO RELATED APPLICATION

This is the 35 U.S.C. §371 national stage of international application PCT/FR01/02867 filed on Sep. 14, 2001, which designated the United States of America.

FIELD OF THE INVENTION

The invention relates to a method for bleaching paper pulps obtained from lignocellulosic raw materials, in particular plant materials of annual plants, agricultural coproducts such as cereal straw, sugarcane or sweet sorghum bagasses, chips of resinous or leafy wood, used paper, and the like.

The invention aims to provide a method allowing efficient and economical bleaching of any type of paper pulps in an aqueous-organic medium having a water content of less than 15% by weight, so as to limit, or even eliminate, aqueous polluting discharges and to obtain paper pulps having a brightness value greater than 70 in only two treatment steps.

The invention extends to bleached paper pulps manufactured by the method and to the paper obtained from said pulps.

BACKGROUND OF THE INVENTION

The traditional methods used for bleaching paper pulps use oxidizing agents which are essentially chlorine, oxygen and derivatives thereof.

The bleaching of paper pulps is carried out by a delignification operation which is complementary to that carried out during the heat and chemical treatment to which the plant is subjected, which leads to the raw paper pulp. This operation consists in an oxidative degradation of the colored molecules, which are essentially formed of more or less recombined lignin fragments, and which form a deposit during cooking on the paper fibers and of the residual lignin present in the fibers after cooking.

Many books and documents describe these operations. Reference will be made, for example, for further information, to the book Chemical Pulping, J. Gullishen, TAPPI and Paper Oy publisher, p 1 to 145, 2000. (www.tappi.org)

Chlorine and its derivatives require considerable quantities of water, greater than 50 tons of water per ton of pulps. The polluted water should then be discharged into rivers.

The pollution, even with a chemical and biological treatment of the effluents before discharge, is considerable with chlorine and sodium hypochlorite, in particular because of the toxicity of the organochlorinated compounds generated.

The use of oxygen, ozone and peroxides of the hydrogen peroxide and peracid type provides a first solution as regards the pollution caused by chlorine and its derivatives.

These technologies are now known and are understood.

In the same manner, reference may be made, for further information, to the book Chemical Pulping, J. Gullishen, TAPPI and Paper Oy publisher, p 146 to 213, 2000. (www.tappi.org) where these technologies are widely described from very recent references.

The quantities of water used remain high and these methods all require more than two steps of bringing the paper pulp to be bleached into contact with chemical reagents.

Furthermore, it is difficult to control the reactivity of ozone and of hydrogen peroxide toward cellulose and polysaccharides, which causes degradation of the mechanical qualities of the paper pulps thus treated.

The number of steps of bringing the paper pulps to be bleached into contact with the quantity of water used and discharged into the environment are as many factors which penalize these technologies from the economic and ecological point of view.

There is another way of manufacturing these bleached paper pulps which is radically different from the conventional methods and which is carried out by oxidative degradation of the lignins which is performed on the initial plant material. These technologies generally use performic acid and/or peracetic acid generated by direct reaction with hydrogen peroxide, with or without a catalyst.

The studies by J. Sundquist and colleagues on this subject appeared in: Papper Och Trä p 88, 2, 1986; and are summarized in Chemical Pulping, J. Gullishen, TAPPI and Paper Oy publisher, p 421 to 425 (www.tappi.org), show that this type of pulps at mechanical qualities of a lower quality. Furthermore, when the peracids are directly used on the plant, the consumption of hydrogen peroxide and of peracids is very high, which economically condemns this type of method.

SUMMARY OF THE INVENTION

The main objective of the invention is to provide a novel method of bleaching which:

- makes it possible to obtain, in only two steps of bringing into contact with chemical reagents, paper pulps having a brightness value greater than 70, which may reach, for paper of higher quality, values greater than 90 (the brightness value is defined on a scale from 0 to 100; the value 100 being that for magnesium carbonate : $MgCO_3$ considered as the absolute reference in terms of brightness) all in accordance with TAPPI standard method T452;
- makes it possible to preserve the mechanical properties of the raw pulps without substantially degrading the cellulosic fibers by preserving in particular a degree of polymerization of said pulps close to that of the raw pulps before bleaching;
- at an economic cost close to or even less than current industrial methods since most of the lignin has been removed during the manufacture of the paper pulp;
- is well suited in particular to all types of raw chemical and semichemical paper pulps.

Another objective of the invention is to work under conditions of hydration of the reaction medium which is as low as possible so as to reduce as much as possible the consumption of water and therefore the aqueous discharges generated by the bleaching operations.

To this end, the method of the invention is characterized in that it combines two successive treatment steps which are:

- bringing the raw pulp into contact with a mixture of peracetic and performic acid, of acetic and formic acid so that the mixture obtained has a water content of less than or equal to 15% by weight of the mixture;
- treating the pulp obtained after mechanical separation of the reaction medium with a solution of hydrogen peroxide in a slightly basic medium ($8<pH<10$).

The bleaching phase occurs mainly in the first step corresponding to bringing the raw pulp into contact with the mixture of performic and peracetic acid which are indeed potent oxidizing agents capable of carrying out the degradation of the residual lignins present, responsible for most of the more or less dark brown color of the raw pulps.

The experiments showed, surprisingly, that the mixture of performic acid and peracetic acid containing little water allowed a particularly efficient bleaching in a single step without degradation of the cellulose fibers.

This result, which is remarkable per se, should be attributed to the capacities of these two peracids to act, via reactive species generated, by rupturing the peracid function, in particular the $OH^+$ ion, which degrades, via an electrophilic substitution, the aromatic rings and the side chains of the lignins, without substantially attacking the carbonyls and the primary and secondary alcohol functions of the sugars.

These reactions, which are very selective for lignins, are therefore without any apparent effect on the cellulose chains, and therefore on the quality of the bleached paper pulp since, in the method of the invention, the degree of polymerization of the cellulose fibers is not or is only slightly affected.

The best results were obtained with a quantity of water limited to 15% by weight of the reaction medium, which differs considerably from the traditional methods, including those using peracids in a bleaching step, a step in which the quantity of water present in the reaction medium is considerably larger.

Under these conditions, the acidity of the medium is buffered by the presence of acetic acid, which can explain the very low degradation of the cellulose fibers.

As the bleaching is performed with an excess of peracids, the solution separated from the bleached pulp is recycled to the peracid producing reactor and treated with hydrogen peroxide at 50% by weight in order to bring the peracid concentration to the required value before being sent into the bleaching reactor.

In this manner, the bleaching agent is in a large excess relative to the coloring products to be destroyed, which makes it possible to better understand the remarkable efficiency of the method.

The mixture of peracetic acid and performic acid is preferably prepared by bringing the acetic acid and the formic acid into contact with hydrogen peroxide at a concentration greater than 50% by weight. An acetic acid+peracetic acid/formic acid+performic acid ratio of the order of 9/1 by volume leads to the best results observed experimentally.

According to a preferred embodiment, the solution of performic acid and acetic acid will circulate countercurrentwise to the stream of pulps and will be sent, before recirculation, into a reactor for bringing into contact with hydrogen peroxide so as to permanently keep an optimum high concentration in contact with the pulp in circulation.

Another preferred embodiment will lead to:

- using a concentration of peracids in contact with the raw pulp of the order of 20% by weight relative to the dry pulp;
- bringing the raw pulps into contact with the mixture of peracids circulating countercurrentwise or in a fixed bed reactor with recirculation of the acids through the pulp;
- regularly reoxidizing through a deviation loop passing into a reactor for contact with hydrogen peroxide, the acetic acid and the formic acid to the corresponding peracids.

The latter operation is made possible by a happy consequence of the method which means that the solutions of performic and peracetic acids contain little or no free lignin, which allows their continuous reuse after reoxidation with hydrogen peroxide.

The contact time between the solution of peracids and the pulp to be bleached will be preferably between 1 and 3 hours.

The preferred treatment temperature may be between 60 and 90° C.

The bleached paper pulp obtained is then deacidified by drying under vacuum.

In a preferred embodiment, the second step is carried out by bringing the deacidified pulp into contact with a basic aqueous solution at a pH of between 8 and 10, containing 1 to 4% by weight of hydrogen peroxide (calculated relative to the treated dry pulp). The treatment temperature will preferably be between 60° C. and 100° C.

The aim of this operation is to finish the bleaching operation, neutralize the last acidic residues and provide, after washing with demineralized water, a stable and neutral, and even very slightly basic, pulp.

The invention extends to the neutral and slightly basic pulps obtained by this technology which are characterized by a low reduction in the degree of polymerization, less than that observed in conventional methods.

BRIEF DESCRIPTION OF THE DRAWINGS

The description which follows, with reference to the appended FIG. 1, illustrates the method of the invention in an optimum embodiment.

The synopsis of FIG. 1 illustrates the implementation of the operations for bleaching the raw pulps. Some operations are known per se.

DETAILED DESCRIPTION OF THE INVENTION

The novelty of the method of the invention consists essentially in the production of peracids by recycling of the aqueous-organic phase containing the organic acids and the residual peracids whose degree of hydration will be controlled.

This makes it possible to have as a final result, a mere consumption of hydrogen peroxide in an operation which is highly superior in terms of selectivity and efficiency to a bleaching phase known per se directly using hydrogen peroxide which cannot in a first stage reach the remarkable performance of the method of the invention.

The paper pulps, dried beforehand so as to have a residual water content of the order of 20%, are therefore exposed to the aqueous-organic solution containing the peracids at a degree of hydration by weight of the order of 5 to 8% by weight.

After a reaction time of the order of 1 to 3 h, the aqueous-organic solution is separated by pressing the pulps which already have a brightness value greater than 65.

The pulps are deacidified in a chamber under vacuum (20 to 30 KPa) heated to a temperature between 60° C. and 85° C.

The organic acids recovered are added to the liquid phase obtained from the pressing.

It should be noted that the residual hydrogen peroxide remains, during this operation, in the pulp.

The solution of organic acids and peracids which is obtained from the pressing and from the deacidification operation under vacuum is dehydrated by azeotropic distillation with the aid of a solvent such as cyclohexane (water/cyclohexane azeotrope: boiling point: 69.8° C. at atmospheric pressure, water content 8.5% by weight).

The aim of this distillation is to maintain the water concentration of the organic acids at a value of the order of 4% by weight, before treating them with a solution of hydrogen peroxide at 50% by weight so as to increase the level of peracids in the reactor provided for this purpose before being sent into the reactor for bleaching in an acidic medium.

The deacidified pulps are introduced into the second reactor and exposed to a solution of hydrogen peroxide in a slightly basic medium (pH 8 to 10) (2% by weight of hydrogen peroxide at 100% relative to the dry pulp). The duration of the treatment is between 1 and 3 hours for a temperature ranging from 60 to 100° C.

This operation allows the finishing of the bleaching by a gain of a few brightness points and makes it possible especially to neutralize the pulps before washing with demineralized water.

The neutral pulps separated by pressing are ready for use.

The washings and the water recovered during dehydration have a low content of organic matter because of the presence, in the bleaching phases, of strong oxidizing agents such as peracids and hydrogen peroxide.

They can be integrally recycled to the production of pulps which, regardless of the method used, requires a certain quantity of water.

The method of the invention, in its optimum implementation, therefore does not produce polluting discharges, in a high-performing economic context, unlike the current bleaching methods.

The following examples, which were carried out in a laboratory, illustrate the method of the invention.

EXAMPLE 1

Bleaching of pulps from wheat straw 50 grams of air-dried wheat straw are delignified in an organic acid medium under the conditions described in French patent No. 97 13658 of Oct. 30, 1997 (publication No. 2 770 543).

When the cooking is complete, the pulp obtained (25 grams of dry matter having a kappa value of 30 and a degree of polymerization of 1 450) is manually pressed and brought into contact with 500 $cm^3$ of a solution of acetic and formic acid and of peracetic and performic acids having an acetic acid+peracetic acid/formic acid+performic acid ratio of 9/1 by volume.

The peracids are prepared by bringing the acetic and formic acids into contact with hydrogen peroxide having a concentration of 50% by weight minimum (temperature 60° C., duration 3 hours).

The concentration of hydrogen peroxide is of the order of 0.35 mol per liter of mixture of organic acids.

The water content of the raw pulps is less than 10% by weight.

The suspension is kept at 60° C. for 3 hours.

When the three hours have elapsed, the pulp is filtered, pressed manually and washed with distilled water.

The peracids and the residual hydrogen peroxide are assayed.

The concentration of peracids in the acids recovered is 0.2 mol per liter, while this concentration in the starting acids was 0.3 mol per liter.

This hydrogen peroxide is 0.08 mol per liter, while this concentration was 0.15 mol per liter in the initial mixture of organic acids and peracids.

The acids recovered are enriched with hydrogen peroxide so as to serve in a new bleaching operation.

The pressed pulps, after washing with distilled water, are brought into contact with a basic solution of hydrogen peroxide containing 4% by weight of sodium hydroxide relative to the dry pulp (pH of the order of 10) and 2% by weight of hydrogen peroxide relative to the dry pulp.

The liquid/solid ratio is 6/1 by weight.

After a contact time of two hours at 90° C., the pulps are filtered, pressed and washed with distilled water and air-dried.

The kappa value is less than 1.

The degree of polymerization is 1,350.

The brightness value is 88.

EXAMPLE NO. 2

50 grams of straw are treated as in example No. 1.

The bleaching of the raw straw pulp (kappa value 30, degree of polymerization: 1,450) in acidic medium is carried out as in example No. 1.

After filtration of the pulps and manual pressing in order to recover the maximum amount of acids, peracids and residual hydrogen peroxide, the pulps are degassed under vacuum in a rotary evaporator.

The pressure is kept at a mean value of 25 Kpa.

The temperature varies from 60° C. to 80° C. from the beginning to the end of the evaporation phase.

This makes it possible to recover condensates with different concentrations of organic acids and of peracids.

The hydrogen peroxide is mostly present in the pulps after evaporation of the acids.

After this evaporation stage, the pulps are brought into contact with a sodium hydroxide solution (pH 10) with a liquid/solid ratio of 7/1.

The treatment temperature is 95° C.

The duration of treatment is 2 hours.

The kappa value obtained is less than 1.

The brightness value is 88.

The degree of polymerization of the bleached pulp obtained is 1,350.

EXAMPLE NO. 3

Bleaching of raw industrial kraft pulps from resinous wood.

25 grams of raw industrial kraft pulps from resinous wood (kappa value of 35, degree of polymerization of 1,500), air-dried, are mixed with 100 cc of a mixture of acetic, formic, peracetic and performic acids which is prepared as in example No. 1.

The peracids are prepared by bringing the acetic and formic acids into contact with hydrogen peroxide having a concentration of 50% by weight minimum (temperature 60° C., duration 3 hours).

The concentration of hydrogen peroxide is of the order of 0.35 mol per liter of mixture of organic acids.

The water content of the raw pulps is less than 10% by weight.

The suspension is kept at 70° C. for 2 hours 30 minutes.

The pulp is then filtered, manually pressed and washed with distilled water.

The peracids and hydrogen peroxide are assayed.

The concentration of peracids in the acids recovered is 0.18 mol per liter, while this concentration in the starting acids was 0.3 mol per liter.

This hydrogen peroxide is 0.07 mol per liter, while this concentration was 0.15 mol per liter in the initial mixture of organic acids and peracids.

The acids recovered are enriched with hydrogen peroxide so as to serve in a new bleaching operation.

The pressed pulps, after washing with distilled water, are brought into contact with a basic solution of hydrogen peroxide containing 4% by weight of sodium hydroxide relative to the dry pulp (pH of the order of 10) and 2% by weight of hydrogen peroxide relative to the dry pulp.

The liquid/solid ratio is 6/1 by weight.

After a contact time of two hours at 85° C., the pulps are filtered, pressed and washed with distilled water and air-dried.

The kappa value is less than 1.

The degree of polymerization of the bleached pulp obtained is 1,350.

The brightness value is 87.

EXAMPLE NO. 4

Bleaching of industrial ammonium bisulfite pulps from resinous wood 25 grams of industrial ammonium bisulfite pulps from resinous wood (kappa value of 30, degree of polymerization of 1,550), air-dried, are treated as in example No. 3.

The brightness value of the bleached pulp obtained is 90. The kappa value is less than 1.

The degree of polymerization is 1,300.

What is claimed is:

1. A method for bleaching raw chemical paper pulps with organic peracids, wherein the method is carried out in two steps at atmospheric pressure and at a temperature of less than or equal to 100° C., and consists essentially of:

a first step of bringing the raw chemical paper pulps into contact with a mixture consisting of peracetic acid and performic acid so as to obtain a reaction medium having a water content of less than or equal to 15% by weight; and a second step of treating the paper pulps obtained, after mechanical separation of the reaction medium obtained at the end of the first step, with a solution consisting of sodium hydroxide and hydrogen peroxide.

2. The method according to claim 1, wherein the peracetic acid and the performic acid are obtained by bringing a mixture of acetic acid and formic acid into contact with hydrogen peroxide having a concentration greater than 50% by weight.

3. The method according to claim 2, wherein the acetic acid+peracetic acid/formic acid+performic acid ratio is of the order of 9/1 by volume.

4. The method according to claim 3, wherein the quantity of peracids at the beginning of the first step is greater than or equal to 20% by weight.

5. The method according to claim 4, wherein the raw chemical paper pulps are brought into contact with the mixture of peracids countercurrentwise with recirculation of the peracids.

6. The method according to claim 5, wherein the solution of peracids after the first step is enriched with peracids so as to bring the concentration of peracids to a chosen value.

7. The method according to claim 6, wherein the pulps treated during the first step are separated from the peracids by pressing.

8. The method according to claim 7, wherein the pressed pulps are deacidified by drying under vacuum, leaving residual hydrogen peroxide in the pulp.

9. The method according to claim 8, wherein the contact time between the peracids and the raw chemical paper pulps is between 1 hour and 3 hours.

10. The method according to claim 9, wherein the treatment temperature is between 60° C. and 90° C.

11. The method according to claim 10, wherein the second step is carried out by bringing the deacidified pulp into contact with a basic aqueous solution having a pH between 8 and 10 containing 1 to 4% by weight of hydrogen peroxide, calculated relative to the dry pulp.

12. The method according to claim 11, wherein the contact time between the deacidified pulp and the hydrogen peroxide in a basic medium is between 1 hour and 3 hour.

13. The method according to claim 12, wherein the pulps obtained during the second step are, after pressing, washed with demineralized water.

14. The method according to claim 3, wherein the water introduced, by the raw chemical pulp, and by the hydrogen peroxide, is extracted from the cycle by distillation.

* * * * *